US012644598B2

(12) United States Patent
Nasato et al.

(10) Patent No.: US 12,644,598 B2
(45) Date of Patent: Jun. 2, 2026

(54) DEVICE FOR ENHANCING REACTION KINETICS FOR INCINERATION PROCESS

(71) Applicant: INDUSTRIAL CERAMICS LIMITED, Milton (CA)

(72) Inventors: Elmo Nasato, Oakville (CA); Nasser Mohieddin Abukhdeir, Mississauga (CA)

(73) Assignee: INDUSTRIAL CERAMICS LIMITED, Milton, CA (US)

( * ) Notice: Subject to any disclaimer, the term of this patent is extended or adjusted under 35 U.S.C. 154(b) by 490 days.

(21) Appl. No.: 18/246,605

(22) PCT Filed: Sep. 27, 2021

(86) PCT No.: PCT/CA2021/051342
§ 371 (c)(1),
(2) Date: Mar. 24, 2023

(87) PCT Pub. No.: WO2022/061473
PCT Pub. Date: Mar. 31, 2022

(65) Prior Publication Data

US 2023/0366540 A1 Nov. 16, 2023

Related U.S. Application Data

(60) Provisional application No. 63/083,683, filed on Sep. 25, 2020.

(51) Int. Cl.
*F23G 7/06* (2006.01)
*F23G 5/44* (2006.01)

(52) U.S. Cl.
CPC ..... *F23G 7/065* (2013.01); *F23G 5/442* (2013.01); *F23G 2204/103* (2013.01); *F23G 2209/14* (2013.01)

(58) Field of Classification Search
CPC .... F23G 7/065; F23G 5/442; F23G 2204/103; F23G 2209/14
USPC ..... 431/116
See application file for complete search history.

(56) References Cited

U.S. PATENT DOCUMENTS 2,999,359 A 9/1961 Reginald
3,568,934 A 3/1971 Dunn
5,707,596 A * 1/1998 Lewandowski ..... F23G 5/14 431/5

(Continued)

FOREIGN PATENT DOCUMENTS

DE 102004056994 A1 8/2006
GB 748509 A 5/1956

(Continued)

OTHER PUBLICATIONS

International Search Report and Written Opinion received for PCT Patent Application No. PCT/CA2021/051342, dated Jan. 10, 2022, 11 pages.

*Primary Examiner* — Avinash A Savani
(74) *Attorney, Agent, or Firm* — AEON Law, PLLC; Adam L.K. Philipp; Charlotte E Holoubek

(57) ABSTRACT

The present invention provides a device for use in a thermal oxidation system for enhancing reaction kinetics for incineration of one or more components of a waste stream, a thermal oxidation system comprising the device, and method of use thereof.

15 Claims, 8 Drawing Sheets

(56) References Cited

U.S. PATENT DOCUMENTS

| | | | | |
|---|---|---|---|---|
| 6,138,586 | A * | 10/2000 | Reichart | F23M 5/00 110/211 |
| 7,273,366 | B1 | 9/2007 | Sujata | |
| 2009/0136406 | A1 | 5/2009 | Johnson et al. | |
| 2013/0244187 | A1 | 9/2013 | Kraus et al. | |
| 2017/0370580 | A1* | 12/2017 | Yamamoto | F23G 5/16 |

FOREIGN PATENT DOCUMENTS

| | | | |
|---|---|---|---|
| WO | 2003095072 | A1 | 11/2003 |
| WO | 2016117167 | A1 | 7/2016 |

* cited by examiner

DEVICE FOR ENHANCING REACTION KINETICS FOR INCINERATION PROCESS

RELATED APPLICATIONS

This application is a national phase entry of PCT international phase patent application No. PCT/CA2021/051342, filed Sep. 27, 2021, in the name of INDUSTRIAL CERAMICS LIMITED [CA], which claims the benefit of priority of U.S. Provisional Patent Application No. 63/083,683, filed Sep. 25, 2020, in the name of INDUSTRIAL CERAMICS LIMITED [CA]. The entire contents of the above-referenced applications and of all priority documents referenced in the Application Data Sheet filed herewith are hereby incorporated by reference for all purposes.

FIELD OF THE INVENTION

The present invention pertains to the field of thermal processing of waste materials. In particular, the invention pertains to a device for use in a thermal oxidation system during incineration of a waste material, a system comprising the device, and method of use thereof.

BACKGROUND OF THE INVENTION

Thermally treating waste matter is a primary method of disposing of hazardous and non-hazardous materials worldwide. Thermal treatment systems can be designed as vapor and liquid incinerators (also known as thermal oxidizers) to dispose of waste streams such as Sulfur Recovery Unit (SRU) tail gas, acid gas, chlorinated hydrocarbons, and other waste gases and liquids.

The thermal oxidation process involves use of a fuel gas stream fired with excess oxygen/air with flame temperature in the range of 2300° F. (1260° C.) to 3200° F. (1760° C.) to provide a heated oxidizing flue gas steam that is mixed with a waste stream that is typically substantially cooler in temperature. The high temperature oxygen molecules in the flue gas react with the contaminants in the waste stream to safely react and dispose of the hazardous material for properly designed and operated units.

Three main factors for improving reaction kinetics are (i) heating/exceeding the activation energy of the reaction, (ii) mixing so that all reactants are in contact with each other, and (iii) creating the heating/mixing conditions uniformly throughout the reactor. Two additional important factors for an effective incineration of a waste stream are the "plug-flow like residence time distribution" of the waste stream, and flow distribution to ensure that the waste stream is introduced in a manner that results in a fully reacted effluent.

SRU tail gas incinerators are designed to safely dispose of the primary waste stream (sulfur tail gas) that may include other streams such as, but not-limited to, the sulfur pit/tank vent and/or amine flash drum gas. These other waste streams have a very low mass flow compared to the tail gas stream and are not a major design consideration, but nevertheless also require incineration for safe dispersion.

The hazardous contaminants in the SRU waste gas stream include $H_2S$, sulfur vapor, COS and $CS_2$, which are oxidized in the thermal oxidizer to form $SO_2$. The primary purpose of a sulfur tail gas oxidizer is to convert $H_2S$ into $SO_2$ to allow for safer thermal dispersion, as $H_2S$ is an extremely toxic gas, even in low concentrations. The specified $H_2S$ emission limit from an oxidizer typically varies from 5 to 10 ppmv. In addition, CO emission limits are often specified given that it is created as part of the combustion process. However, $H_2S$ combustion occurs at a much lower auto ignition temperature (529° F., 276° C.) than CO (1166° F., 630° C.), imposing additional constraints on SRU tail gas incinerator operation. Emissions of CO are typically not guaranteed unless the operating temperature is above 1400° F. (760° C.) and, as with any combustion system, the higher the operating temperature the lower the CO emissions. However, as operating temperatures increase, fuel gas consumption, $CO_2$ emissions, and the risk for NOx emissions also increase.

Therefore, there is a need for a thermal oxidation system which can effectively thermally oxidize/incinerate contaminants with different auto ignition temperatures in a waste stream, at lower operating temperatures, while also reducing fuel gas consumption.

This background information is provided for the purpose of making known information believed by the applicant to be of possible relevance to the present invention. No admission is necessarily intended, nor should be construed, that any of the preceding information constitutes prior art against the present invention.

SUMMARY OF THE INVENTION

An object of the present invention is to provide a device for use in a thermal oxidation system for enhancing reaction kinetics for the oxidation/incineration process.

In accordance with an aspect of the invention, there is provided a device for use in a thermal oxidation system for enhancing reaction kinetics for incineration of one or more components of a waste stream, the thermal oxidation system comprising a combustion chamber having a chamber inlet in fluid communication with a burner configured to combust a fuel and air mixture to form a thermal oxidizer flue gas for the incineration of the one or more components of the waste stream, and a chamber outlet for exhausting the incineration products. The device comprises an elongated body having a first end, a second end, a side wall extending between the first end and the second end, the body having a device inlet configured to receive the waste stream, and a device outlet to introduce the waste stream into the combustion chamber, and the body defining a passage between the device inlet and the device outlet; wherein the device is configured to be positioned within the combustion chamber to introduce the waste stream and/or direct the waste stream flow in the combustion chamber in a direction that promotes mixing of the waste stream with the thermal oxidizer flue gas.

In accordance with another aspect of the invention, there is provided a thermal oxidation system comprising one or more devices as described herein, for enhancing reaction kinetics for incineration of one or more components of the waste stream,

BRIEF DESCRIPTION OF THE FIGURES

The invention will now be described by way of an exemplary embodiment with reference to the accompanying simplified, diagrammatic, not-to-scale drawings. In the drawings.

DETAILED DESCRIPTION OF THE INVENTION

Figure 1:
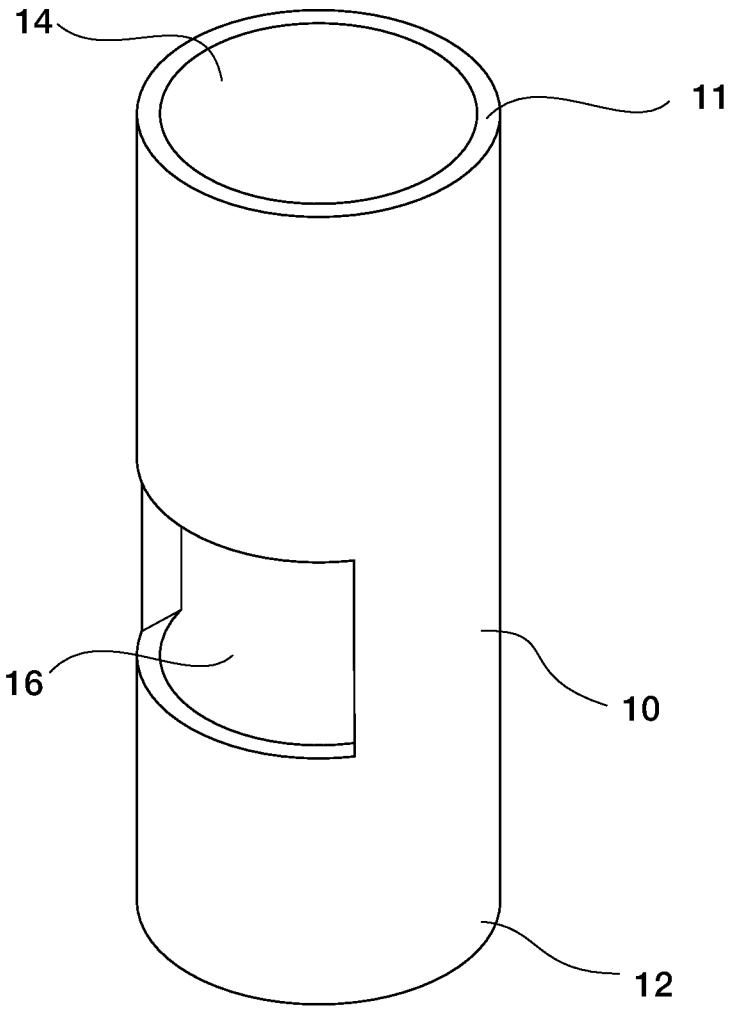
FIG. 1 is a schematic perspective view of a device in accordance with an embodiment of the present invention.

Unless defined otherwise, all technical and scientific terms used herein have the same meaning as commonly understood by one of ordinary skill in the art to which this invention belongs.

The expressions "thermal oxidation system" and "thermal oxidizer" are used interchangeably in the context of the present invention.

As used herein, the expression "thermal oxidizer flue gas" refers to a hot flue gas product obtained after firing a fuel stream with an excess of air, and comprises an oxidizing agent, such as oxygen and $SO_2$ etc., available to oxidize components of a waste stream to provide the final incineration product.

As used herein, the term "about" refers to approximately a +/−10% variation from a given value. It is to be understood that such a variation is always included in any given value provided herein, whether or not it is specifically referred to.

The present invention provides a device that can be incorporated into thermal oxidation systems to improve mixing of the combustion gas/thermal oxidizer flue gas stream with a waste stream (preferably gaseous waste stream), by redirecting the waste stream to impinge on the combustion stream to promote uniform mixing, which improves the reaction kinetics.

The device can also improve heat transfer from a waste stream prior to the contact of the waste stream with the combustion gas, and introduce the heated waste stream into the oxidizing hot flue gas stream to promote uniform mixing. Such an embodiment of the device of the present invention further improves reaction kinetics by increasing the retention of thermal energy required to sustain auto-ignition of contaminants with different auto-ignition temperatures, for example, $H_2S$ and CO.

The high temperature thermal oxidizer flue gas contains excess oxygen and thermal energy to enable the oxidation of the hazardous contaminants. The device of the present invention can provide for 1) preheating of the waste stream using thermal energy of the oxidizer flue gas, and 2) introduction of the heated waste stream into an optimal region of the combustion chamber of the thermal oxidizer relative to the oxidizer flue gas stream inlet flow and average direction.

Without being bound by theory, it is believed that increasing the temperature of the waste stream prior to interaction with the oxidizer flue gas stream lowers the activation energy required for the reaction, thus further improving the process kinetics and resulting in better contaminant destruction at lower operating temperatures. The device of the present invention further enhances the kinetics of the oxidation of the contaminants by optimizing the inlet flows to maximize the sub-volume of the unit which is above the auto-ignition temperature of the contaminants. Furthermore, improving the retained thermal energy in the oxidizer flue gas improves the overall efficiency of the thermal oxidizer.

The improved kinetics maximizes reaction conversion of the contaminants, resulting in both reduction of emissions and fuel gas consumption. Reduced fuel gas consumption translates to lower $CO_2$ emissions and lower operating costs.

In one aspect, the present invention provides a device for use in a thermal oxidation system for enhancing reaction kinetics for incineration of one or more components of a waste stream (preferably gaseous waste stream). The device is configured to be positioned in a combustion chamber of the thermal oxidation system. The combustion chamber has a chamber inlet in fluid communication with a burner configured to combust a fuel and air mixture to form a thermal oxidizer flue gas for the incineration of the waste stream, and a chamber outlet for exhausting the incineration products.

The device has an elongated body provided with a device inlet configured to receive the waste stream and a device outlet configured to release/introduce a waste stream into the combustion chamber. The device is configured to be positioned within the combustion chamber in the flow stream of the oxidizer flue gas. The body defines a passage between the device inlet and the device outlet. The device is configured to be positioned within the combustion chamber to introduce the waste stream and/or direct the waste stream flow in the combustion chamber in a direction that promotes mixing of the waste stream with the thermal oxidizer flue gas.

For example, the device can be configured to introduce the waste stream and/or direct the waste stream flow of the waste stream at an angle between 0° to 180° relative to the direction of flow of the thermal oxidizer flue gas.

In some embodiments, the device can be configured to introduce the waste stream and/or direct the waste stream flow in a direction that is between an angle of 90° relative to the flow direction of the flue gas and an angle opposing the flow direction of the thermal oxidizer flue gas.

The device inlet comprises one or more openings located at or proximate the first end of the elongated body or one or more openings in the side wall of the elongated body. The device inlet can be oriented vertically, horizontally and/or tangentially relative to the longitudinal axis of the device, and relative to nozzle locations of the waste gas stream(s) lines in fluid communication with the inlet(s).

The device outlet is configured to provide a controlled point of introduction of the heated waste stream into the hot oxidizer flue gas stream. In some embodiments, the device outlet is oriented to introduce the waste stream in a generally upstream direction relative to the flow of the thermal oxidizer flue gas (for example in a counter-flow direction relative to the flow of the thermal oxidizer flue gas). In some embodiments, the device outlet is oriented to introduce the waste stream in a cross-flow direction relative to the flow of the thermal oxidizer flue gas. In some embodiments, there may be a combination of counter-flow, cross-flow and/or co-current-flow regimes.

In a preferred embodiment, the device outlet is oriented to introduce the heated waste stream in a counter-flow direction relative to the flow of the thermal oxidizer flue gas.

The device outlet can be positioned anywhere along the body of the device. In some embodiments, the device outlet comprises one or more openings in a side wall of the elongated body. In some embodiments, the side wall opening is located at or proximate an end of the elongated body. In some embodiments, the side wall opening is located at an intermediate point between the ends of the elongated body.

In some embodiments, the device outlet is spaced from the device inlet to allow the waste stream to be heated while passing through the passage of the device from the inlet towards the outlet.

In some embodiments, the device inlet is located at or proximate the first end of the elongated body and the device outlet is an opening in the side wall located at or proximate the second end of the elongated body.

In some embodiments, the device inlet and the device outlet are one or more openings in the side wall located between the first and second ends of the elongated body.

In some embodiments, the device further comprises at least one baffle member to increase turbulence, which improves mixing of the heated waste stream with the hot oxidizer flue stream, and/or to increase temperature within the oxidation chamber upstream of the baffle member.

In some embodiments, the at least one baffle member extends outwardly from the body. In some embodiments, at least one baffle member extends the entire length of the elongated body.

In some embodiments, the baffle member is a helical baffle member positioned around the elongated body.

In some embodiments, the device comprises a wall member coupled to or integral with the elongated body. In some embodiments, the wall member has a plurality of pass-through regions or perforations. In some embodiments, the wall member is configured to extend across at least a portion of the cross section of the combustion chamber In some embodiments, the device is configured to be oriented orthogonal to the flow of the thermal oxidizer flue gas.

In some embodiments, the combustion chamber of the thermal oxidizer is an elongated chamber having a longitudinal axis, wherein one or more of the devices of the present invention can be oriented orthogonally to the longitudinal axis of the combustion chamber. In some embodiments, one or more of the devices are sized to extend partially across the internal width of the combustion chamber. In some embodiments, one or more of the devices are sized to extend across the entire internal width of the combustion chamber.

The device of the present invention can be constructed from any suitable material, which is resistant to high heat and maintains structural integrity of the device. Such materials may include, for example, refractory material, heat resistant metal(s), heat resistant metal alloy(s), etc. Non limiting examples of suitable refractory materials include ceramic materials such as bricks, castables, ceramic fibers, etc. Metals can optionally be coated with a ceramic material, or lined with ceramic bricks, castables, and/or ceramic fibers.

The body can be made as one piece from a suitable metal and/or metal alloy, or by joining two or more modules or pieces. In some embodiments, the device can be constructed from stackable units such as bricks.

The body can have any cross sectional shape, such as circular, elliptical, hexagonal, square, rectangular, etc.

In some embodiments, the device may be constructed from a designed material that may further act as a catalyst to promote the oxidation of the hazardous species in the waste stream that come in contact with the device. For example, a material that can promote oxidation of sulfur compounds to $SO_2$ and/or CO to $CO_2$. Preferably, suitable materials should not result in $SO_3$ formation.

In another aspect, the present invention provides a thermal oxidation system for thermal incineration of one or more components of a waste stream, equipped with one or more devices of the present invention as described herein. The device(s) of the present invention can be retrofitted to existing thermal oxidizer systems or can be included in new clean-sheet designs.

In one embodiment, the present invention provides a thermal oxidation system comprising a combustion chamber having a chamber inlet in fluid communication with a burner configured to combust a fuel and air mixture to form a thermal oxidizer flue gas for the incineration of the waste stream and a chamber outlet for exhausting the incineration products, and at least one device as described above placed in the combustion chamber.

The device inlet of the at least one device is in fluidic communication with a respective waste-stream line, wherein the portion of the waste-stream line fluidically communicating with the device inlet(s) is oriented vertically, horizontally and/or tangentially relative to the longitudinal axis of the device.

In some embodiments, the combustion chamber is a horizontally oriented elongated chamber having a longitudinal axis, and the at least one device is oriented orthogonal to the longitudinal axis of the combustion chamber. In some embodiments, one or more of the devices extend partially across the internal width of the combustion chamber. In some embodiments, one or more of the devices extend across the entire internal width of the chamber.

In the embodiments comprising two or more inlets for receiving waste stream, the waste stream lines can be configured to deliver same waste stream via all inlets or different waste streams via a respective inlet.

In some embodiments, the system comprises two or more devices, wherein each device has at least one inlet in communication with a respective waste-stream line. In some embodiments, each waste-stream line supplies same waste stream. In some embodiments, the waste stream lines are configured to supply different waste streams to the two or more devices.

Controlled introduction of the waste stream allows for the precise control of excess oxygen in the oxidizer flue gas. Optimizing the oxygen content of the flue gas would maximize the flue gas temperature and increase the activation temperature of the system. Optimizing the oxygen content of the oxidizer flue gas would minimize the fuel gas consumption and minimize $CO_2$ emissions and lower operating costs.

The pre-heating effect of the device(s) on the waste gas stream would lower the fuel gas consumption required to raise the bulk temperature of the combined streams. Lower fuel gas consumption directly reduces the $CO_2$ emissions associated with thermal oxidation.

Higher waste stream temperature in conjunction with the controlled introduction of waste stream into the flue gas stream would improve the kinetics of the oxidation reaction.

To gain a better understanding of the invention described herein, the following examples are set forth with reference to the accompanying drawings, which are not drawn to scale, and the illustrated components are not necessarily drawn proportionately to one another. It will be understood that these examples are intended to describe illustrative embodiments of the invention and are not intended to limit the scope of the invention in any way.

EXAMPLES

FIGS. 1 to 4 depict examples of the device of the present invention.

With reference to FIG. 1, the device has an elongated body 10 having first end 11 and second end 12, wherein the device inlet 14 is provided at the first end, and the device outlet 16 is provided on the side wall along the body.

Figure 2:
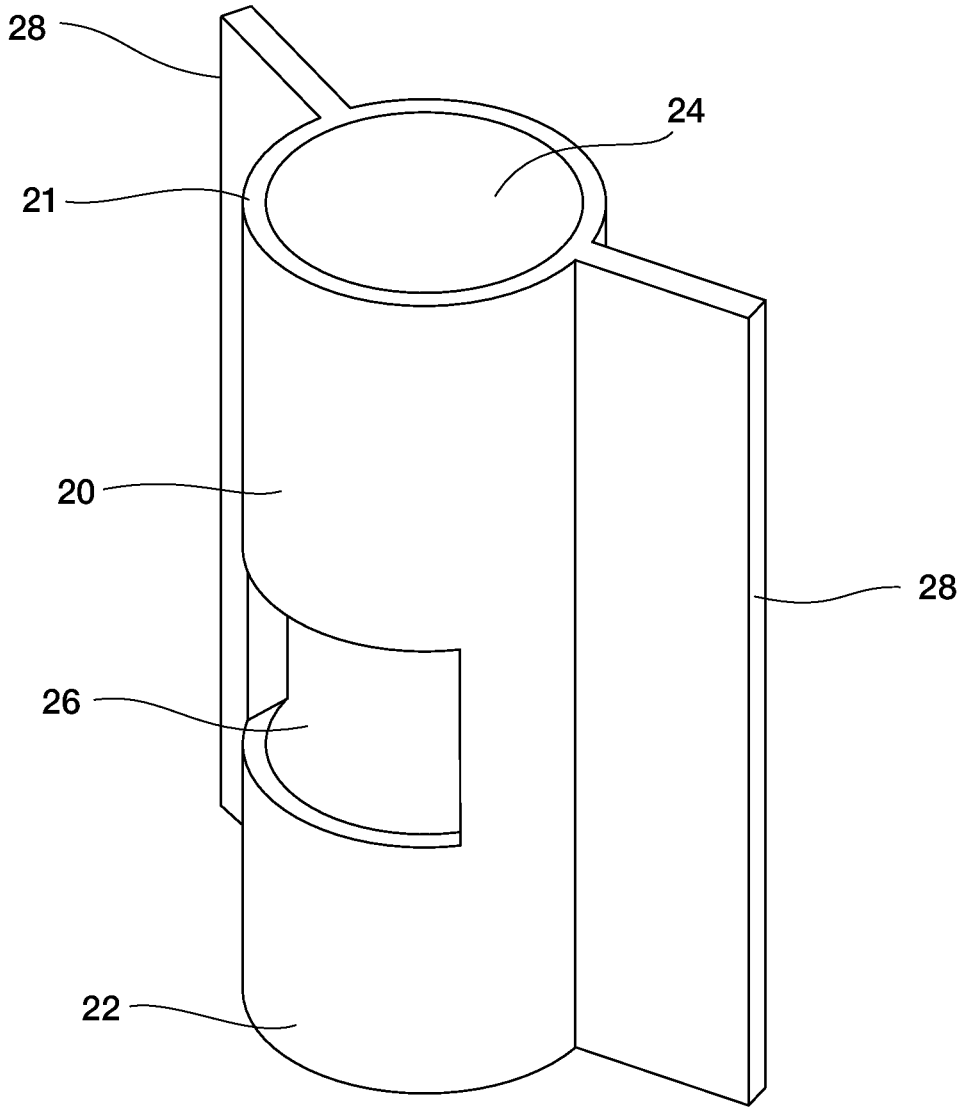
FIG. 2 is a schematic perspective view of a device in accordance with an embodiment of the present invention.

With reference to FIG. 2, the device has an elongated body 20 with the first end 21 and the second end 22, wherein the device inlet 24 is provided at the first end, and the device outlet 26 is provided on the side wall along the body. The device of this example has two baffle members 28 extending outwardly from the body downstream of the outlet 26.

Figure 3:
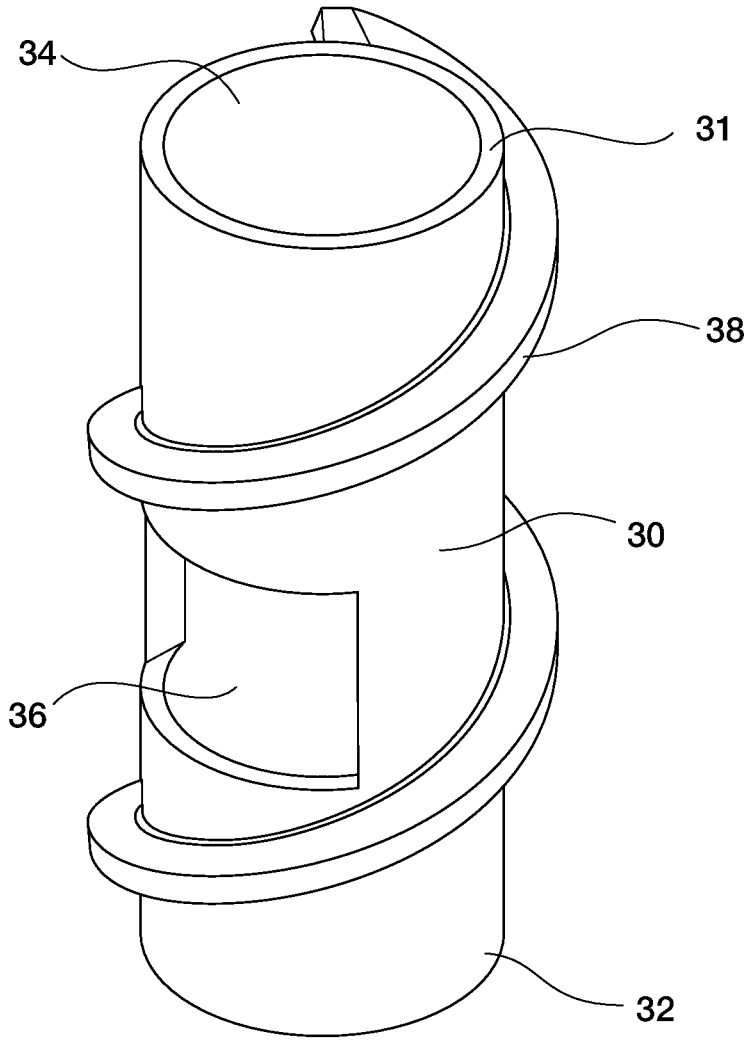
FIG. 3 is a schematic perspective view of a device in accordance with an embodiment of the present invention.

With reference to FIG. 3, the device has an elongated body 30 with the first end 31 and the second end 32, wherein the device inlet 34 is provided at the first end, and the device outlet 36 is provided on the side wall along the body. The device of this example has a helical baffle member 38 positioned around the elongated body.

Figure 4:
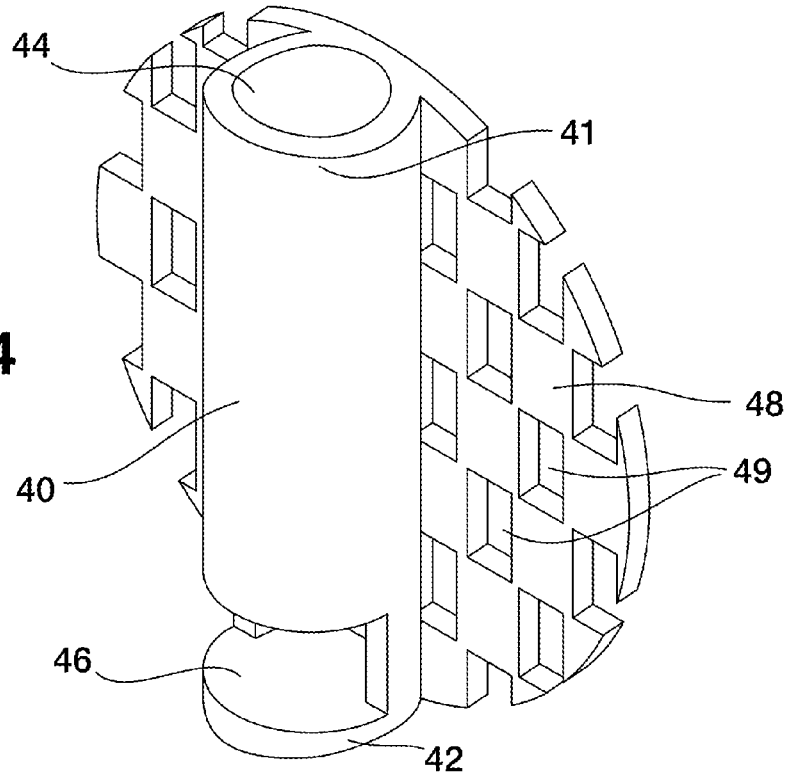
FIG. 4 is a schematic perspective view of a device in accordance with an embodiment of the present invention.

With reference to FIG. 4, the device has an elongated body 40 with the first end 41 and the second end 42, wherein the device inlet 34 is provided at the first end, and the device outlet 46 is provided on the side wall at the second end 42. The device of this example has a wall member 48 coupled to the elongated body. The wall member is provided with a plurality of pass-through regions 49.

Figure 5:
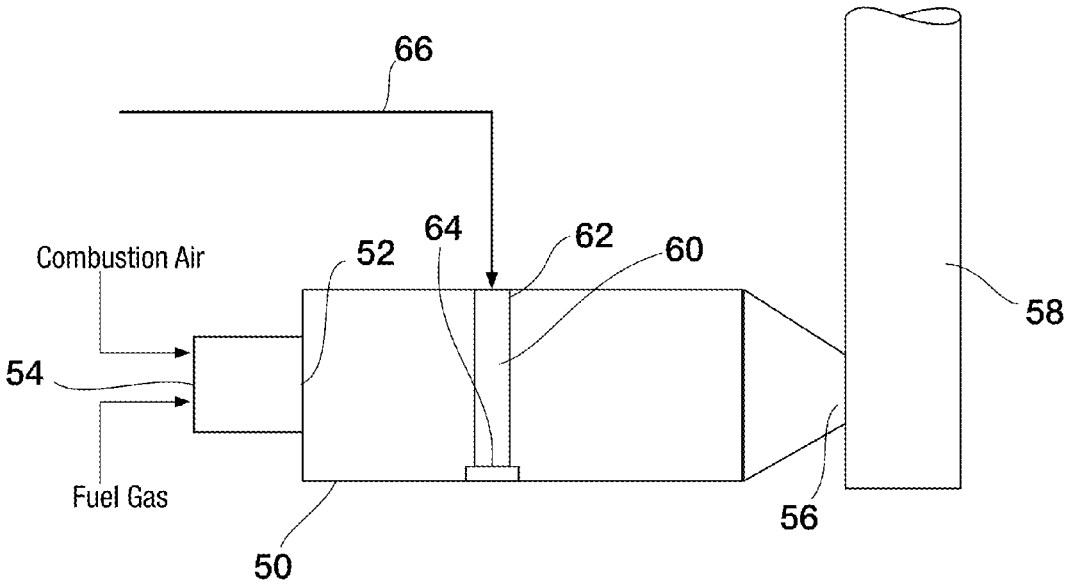
FIG. 5 is a schematic depiction of a thermal oxidation system comprising a device in accordance with an embodiment of the present invention.

FIG. 5 is a schematic depiction of a thermal oxidation system equipped with an exemplary device of the present invention. With reference to FIG. 5, the thermal oxidation system comprises a horizontally oriented elongated combustion/oxidation chamber 50 having a chamber inlet 52 in fluid communication with a burner 54 defining a flame zone, and a chamber outlet 56 in fluid communication with an exhaust stack 58. The burner 54 receives the combustion air and fuel gas and combusts the air and fuel gas mixture to form a thermal oxidizer flue gas which enters the combustion chamber via the inlet 52. An exemplary device having elongated body 60 having the first end 62 and the second end 64 is positioned orthogonal to the longitudinal axis of the oxidation chamber 50. The device inlet is provided at the first end of the body to be in fluidic communication with a waster gas stream line 66, such that at least a portion of the line 66 is oriented vertically/co-axially relative to longitudinal axis of the body, and the device outlet (not shown) is provided on the side wall. In this example, the device is sized to extend entire internal width/diameter of the combustion chamber.

Figure 6A:
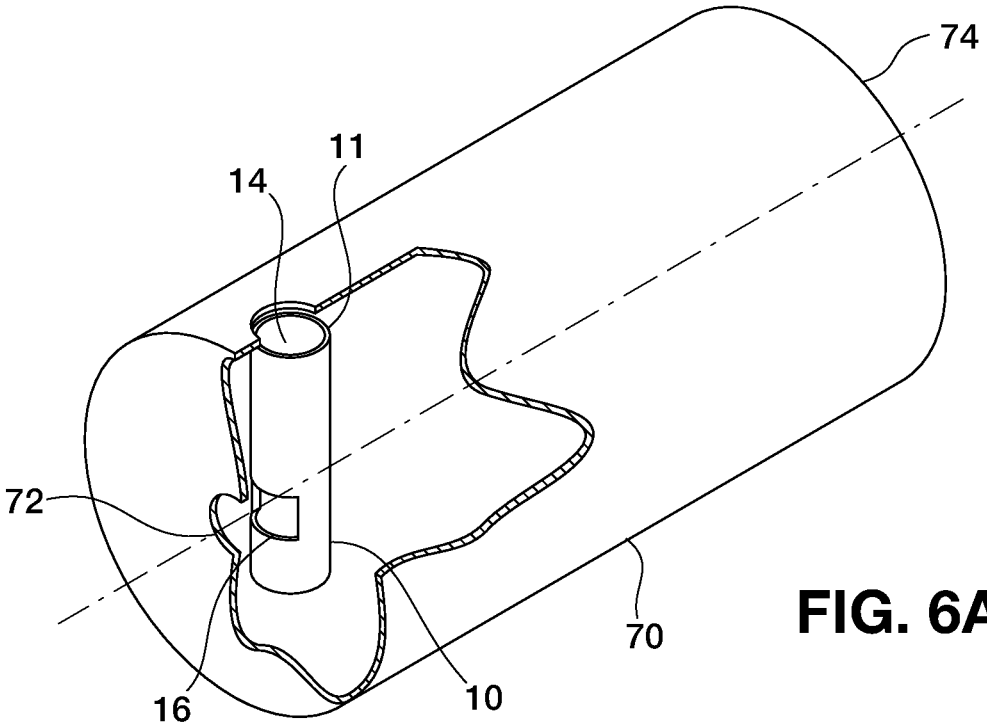
FIG. 6A is a schematic partially cut perspective view of a combustion chamber showing a device in accordance with an embodiment of the present invention placed therein.

FIG. 6A is a schematic depiction of the exemplary device of FIG. 1 positioned within a combustion chamber 70 having chamber inlet 72 and chamber outlet 74, wherein the device outlet 16 is oriented to introduce the heated waste stream in a counter-flow direction relative to the flow of the thermal oxidizer flue gas.

Figure 6B:
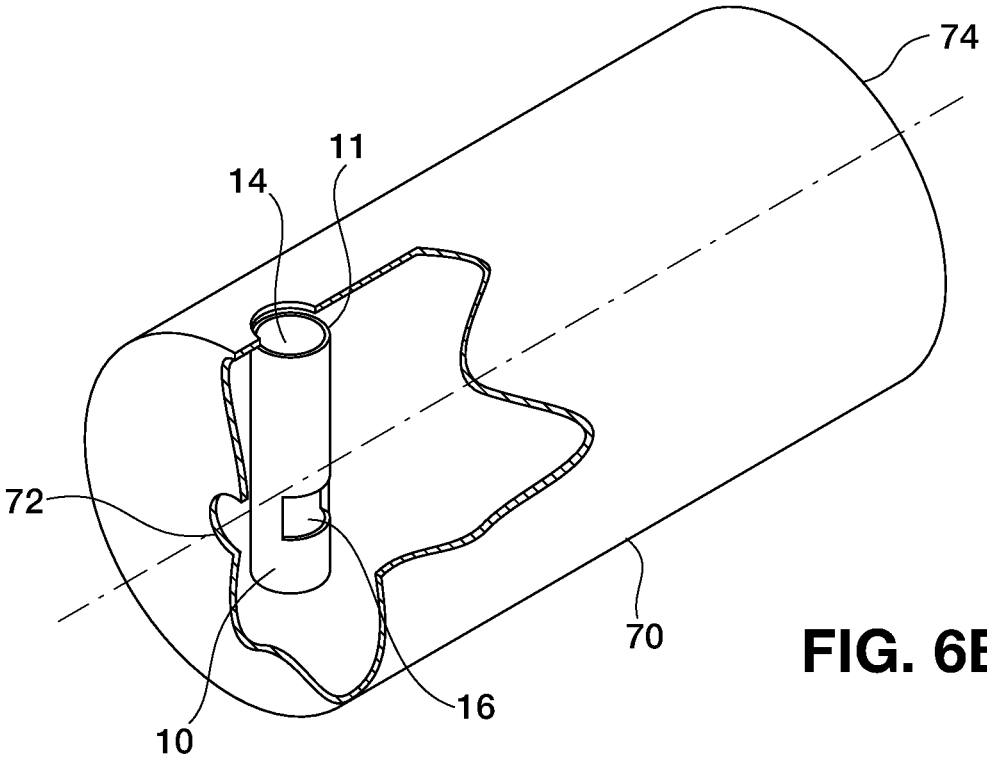
FIG. 6B is a schematic partially cut perspective view of a combustion chamber showing a device in accordance with an embodiment of the present invention placed therein.

FIG. 6*b* is a schematic depiction of the exemplary device of FIG. 1 positioned within a combustion chamber 70 having chamber inlet 72 and chamber outlet 74, wherein the device outlet 16 is oriented to introduce the heated waste stream in a cross-flow direction relative to the flow of the thermal oxidizer flue gas.

Figure 7:
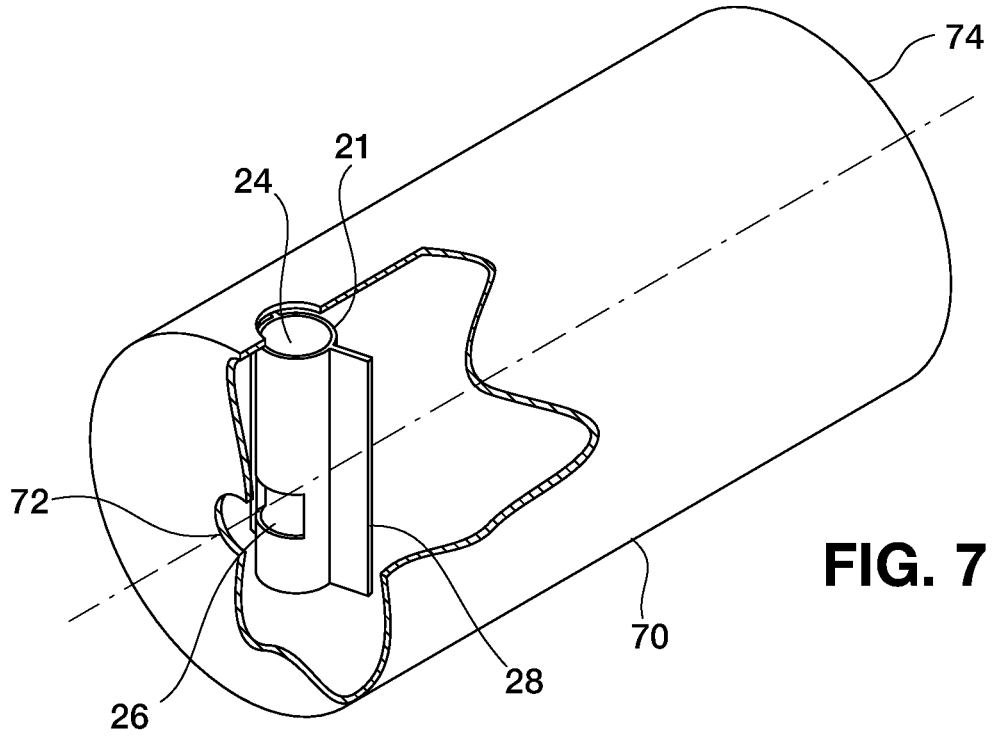
FIG. 7 is a schematic partially cut perspective view of a combustion chamber showing a device in accordance with an embodiment of the present invention placed therein.

FIG. 7 is a schematic depiction of the exemplary device of FIG. 2 positioned within a combustion chamber 80 having chamber inlet 82 and chamber outlet 84, wherein the device outlet 26 is oriented to introduce the heated waste stream in a counter-flow direction relative to the flow of the thermal oxidizer flue gas.

Figure 8:
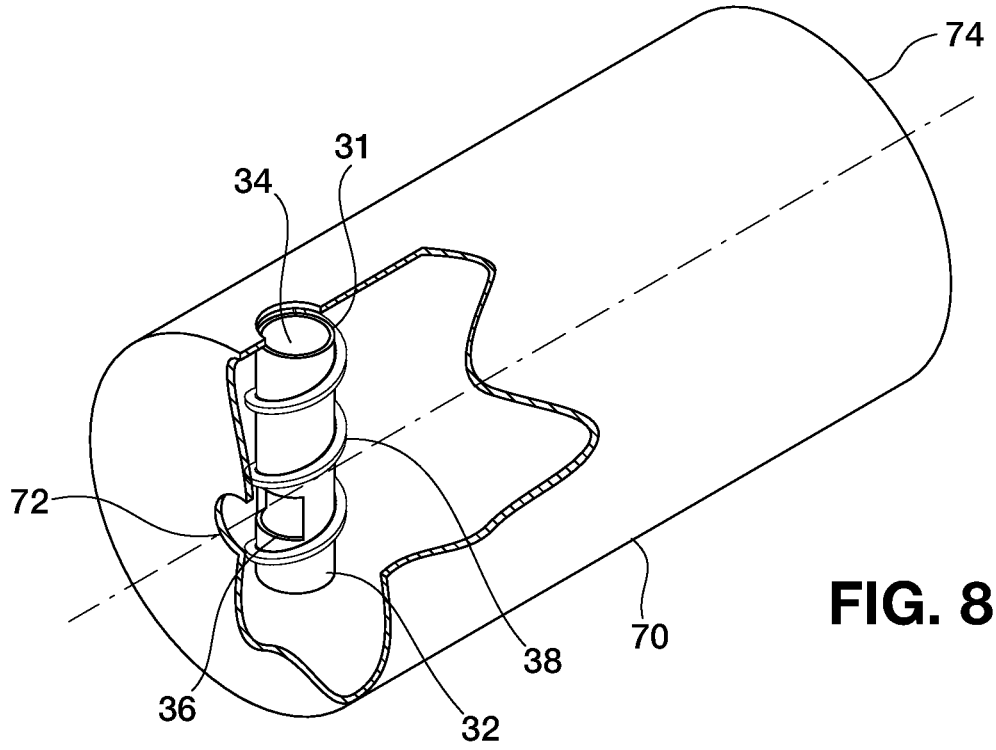
FIG. 8 is a schematic partially cut perspective view of a combustion chamber showing a device in accordance with an embodiment of the present invention placed therein.

FIG. 8 is a schematic depiction of the exemplary device of FIG. 3 positioned within a combustion chamber 90 having chamber inlet 92 and chamber outlet 94, wherein the device outlet 36 is oriented to introduce the heated waste stream in a counter-flow direction relative to the flow of the thermal oxidizer flue gas.

In examples of FIGS. 6 to 8, the device is sized to extend partially across the internal width/diameter of the combustion chamber.

Figure 9:
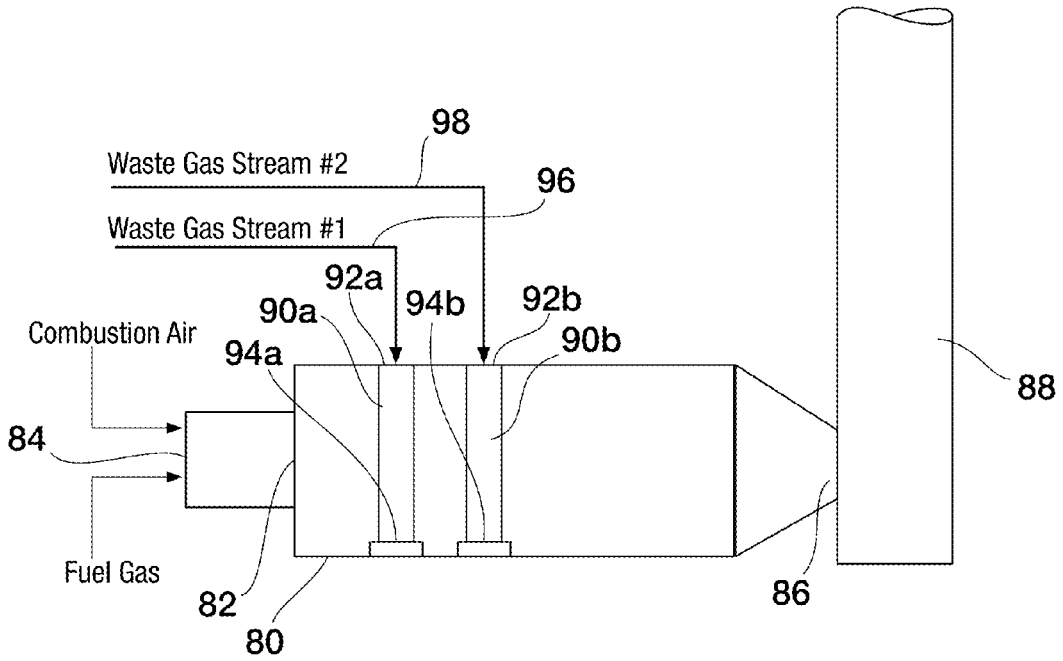
FIG. 9 is a schematic depiction of a thermal oxidation system comprising two devices in accordance with an embodiment of the present invention.

FIG. 9 is a schematic depiction of a thermal oxidation system equipped with two exemplary devices of the present invention. With reference to FIG. 9, the thermal oxidation system comprises a horizontally oriented elongated combustion/oxidation chamber 80 having a chamber inlet 82 in fluid communication with a burner 84 defining a flame zone, and a chamber outlet 86 in fluid communication with an exhaust stack 68. The burner 84 receives the combustion air and fuel gas and combusts the air and fuel gas mixture to form a thermal oxidizer flue gas which enters the combustion chamber via the inlet 82.

Two exemplary devices 90*a* and 90*b* are positioned orthogonal to the longitudinal axis of the oxidation chamber 80. Each of the devices 90*a* and 90*b*, have an elongated body having the first end 92*a*, 92*b* and the second end 94*a*, 94*b*, respectively. These devices are sized to extend entire internal width/diameter of the combustion chamber. Each device has an inlet (not shown) at the first end oriented vertically relative to the longitudinal axis of the body, and the device outlet (not shown) is provided on the side wall. The inlet(s) of each device is in fluid communication with a respective waste-stream line 96 and 98. In this example the waste steam lines 96 and 98 can provide same waste material or different waste material.

Figure 10A:
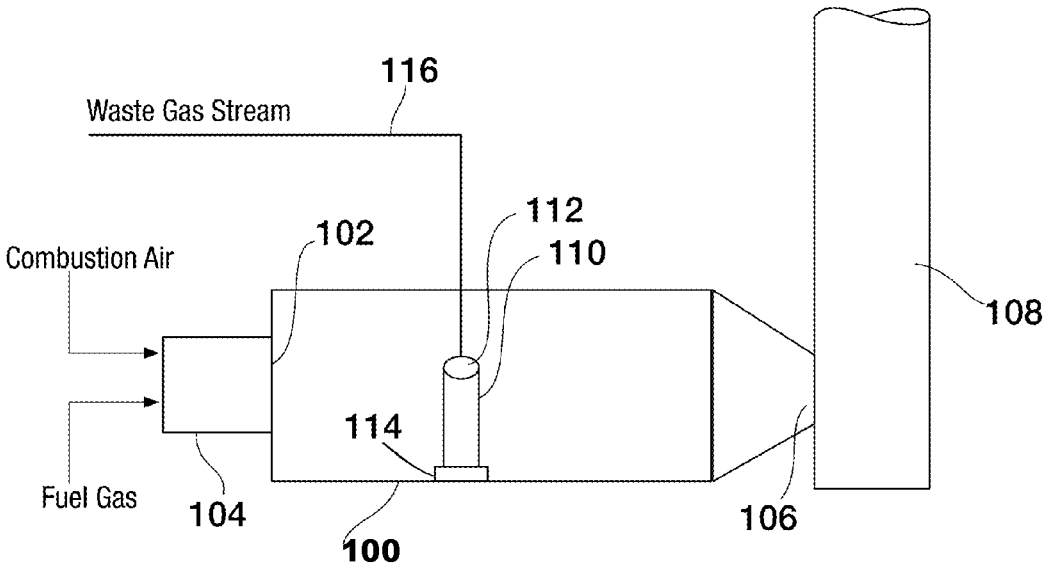
FIGS. 10A and 10B are schematic depictions of a thermal oxidation system comprising a device in accordance with an embodiment of the present invention.
Figure 10B:
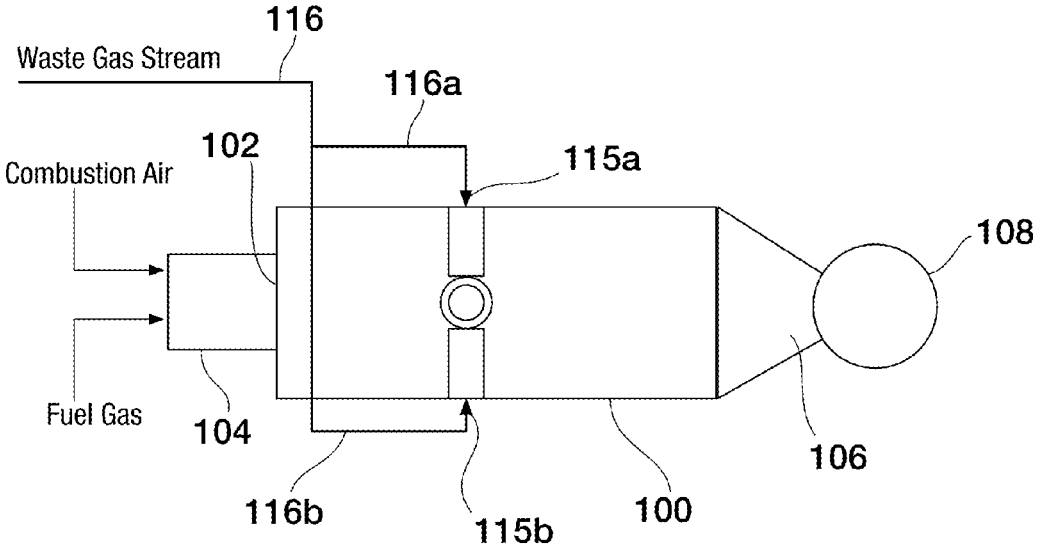

FIGS. 10A and 10B are schematic depictions of a thermal oxidation system equipped with one exemplary device of the present invention. FIG. 10A is side view of the system and FIG. 10 B is a top view thereof. With reference to FIGS. 10A and B, the thermal oxidation system comprises a horizontally oriented elongated combustion/oxidation chamber 100 having a chamber inlet 102 in fluid communication with a burner 104 defining a flame zone, and a chamber outlet 106 in fluid communication with an exhaust stack 108. The burner 104 receives the combustion air and fuel gas and combusts the air and fuel gas mixture to form a thermal oxidizer flue gas which enters the combustion chamber via the inlet 102.

The exemplary device 110 having an elongated body having the first end 112 and the second end 114, is positioned orthogonal to the longitudinal axis of the oxidation chamber 100. The device is sized to extend partially across the internal width/diameter of the combustion chamber. The device has two opposing inlets 115*a* and 115*b* provided on the side wall of the device. The device outlet (not shown) is provided on the side wall. The inlets 115*a* and 115*b* of the device are in fluid communication with manifolded lines 116*a* and 116*b*, respectively of a main waste-stream line 116. In this example, at least a portion of the lines 116*a* and 116*b* is oriented horizontally relative to the longitudinal axis of the device body.

Simulation-based evaluation of a tail gas incinerator reactor with the device depicted in FIGS. 1 and 6A was performed in comparison to a system without the device of the present invention, which exhibit significant improvement in the conversion of $H_2S$ and CO, wherein a cumulative reduction in emissions of approx. 40+% can be achieved. Simulations evaluations also depicted that a 20% reduction in fuel consumption could be achieved while maintaining base case emission standards.

Although the invention has been described with reference to certain specific embodiments, various modifications thereof will be apparent to those skilled in the art without departing from the spirit and scope of the invention. All such modifications as would be apparent to one skilled in the art are intended to be included within the scope of the following claims.

The invention claimed is:

1. A device for use in a thermal oxidation system for enhancing reaction kinetics for incineration of one or more components of a gaseous waste stream, the thermal oxidation system comprising a combustion chamber having a chamber inlet in fluid communication with a burner configured to combust a fuel and air mixture to form a thermal oxidizer flue gas for the incineration of the one or more components of the waste stream, and a chamber outlet for exhausting the incineration products, the device comprising:

an elongated body having a first end, a second end, a side wall extending between the first end and the second end, the body having a device inlet configured to receive the waste stream, and a device outlet configured to introduce the waste stream into the combustion chamber, and the body defining a passage between the device inlet and the device outlet;

wherein the device outlet is spaced from the device inlet to allow the waste stream to be heated while passing through the passage of the device from the inlet towards the outlet;

wherein the device inlet comprises one or more openings located at or proximate the first end of the elongated body, and the device outlet comprises one or more openings in the side wall of the elongated body, located at or proximate the second end of the elongated body, or at an intermediate point between the first and second ends of the elongated body;

wherein the device is configured to be positioned within the combustion chamber orthogonal to the direction of flow of the thermal oxidizer flue gas through the combustion chamber from the chamber inlet towards the chamber outlet, to introduce the waste stream and/or direct the waste stream flow in the combustion chamber between an angle of 90° relative to the flow direction of the thermal oxidizer flue gas and an angle opposing the flow direction of the thermal oxidizer flue gas to promote mixing of the waste stream with the thermal oxidizer flue gas.

2. The device of claim 1, wherein the device outlet is one opening in the side wall located at or proximate the second end of the elongated body, or at an intermediate point between the first and second ends of the elongated body.

3. The device of claim 1, wherein the device further comprises at least one baffle member extending outwardly from the body, or a helical baffle member around the elongated body.

4. The device of claim 1, wherein the device further comprises a wall member coupled to or integral with the elongated body, the wall member has a plurality of pass-through regions/perforations, and is further configured to extend across at least a portion of the cross section of the combustion chamber.

5. The device of claim 1, wherein the combustion chamber is an elongated chamber having a longitudinal axis, and the device is configured to be oriented orthogonal to the longitudinal axis of the combustion chamber.

6. The device of claim 1 wherein the device outlet is oriented to introduce the waste stream in a counter-flow direction or a cross-flow direction relative to the flow of the thermal oxidizer flue gas.

7. A thermal oxidation system for incineration of a gaseous waste stream, the system comprising:

a combustion chamber having a chamber inlet in fluid communication with a burner configured to combust a fuel and air mixture to form a thermal oxidizer flue gas for the incineration of the waste stream, and a chamber outlet for exhausting the incineration products; and at least one device in fluidic communication with a respective waste-stream line, and positioned within the combustion chamber for enhancing reaction kinetics for incineration of one or more components of the waste stream, the at least one device having an elongated body having a first end, a second end, a side wall extending between the first end and the second end, the body having a device inlet configured to receive the waste stream, and a device outlet configured to introduce the waste stream into the combustion chamber, and the body defining a passage between the device inlet and the device outlet;

wherein the device outlet is spaced from the device inlet to allow the waste stream to be heated while passing through the passage of the device from the inlet towards the outlet;

wherein the device inlet comprises one or more openings located at or proximate the first end of the elongated body and the device outlet comprises one or more openings in the side wall of the elongated body located at or proximate the second end of the elongated body, or at an intermediate point between the first and second ends of the elongated body; and wherein the device is positioned within the combustion chamber orthogonal to the direction of flow of the thermal oxidizer flue gas through the combustion chamber from the chamber inlet towards the chamber outlet, to introduce the waste stream and/or direct the waste stream flow in the combustion chamber in a direction that is between an angle of 90° relative to the flow direction of the thermal oxidizer flue gas and an angle opposing the flow direction of the thermal oxidizer flue gas to promote mixing of the waste stream with the thermal oxidizer flue gas.

8. The system of claim 7, wherein the device outlet is one opening in the side wall located at or proximate the second end of the elongated body, or at an intermediate point located between the first and second ends of the elongated body.

9. The system of claim 7, wherein the device further comprises at least one baffle member extending outwardly from the body or a helical baffle member around the elongated body.

10. The system of claim 7, wherein the device further comprises a wall member coupled to or integral with the elongated body, the wall member has a plurality of pass-through regions/perforations, and the wall member is further configured to extend across at least a portion of the cross section of the combustion chamber.

11. The system of claim 7, wherein the combustion chamber is an elongated chamber having a longitudinal axis, and the at least one device is oriented orthogonal to the longitudinal axis of the combustion chamber.

12. The system of claim 11, wherein the device extends partially across the internal width of the combustion chamber or extends across the entire internal width of the combustion chamber.

13. The system of claim 7, wherein at least a portion of the waste-stream line is oriented vertically, horizontally and/or tangentially relative to the longitudinal axis of the device.

14. The system of claim 7, wherein the system comprises two or more devices each having at least one inlet in communication with a respective waste-stream line.

15. The system of claim 7, wherein the device outlet is oriented to introduce the waste stream in a counter-flow direction or a cross-flow direction relative to the flow of the thermal oxidizer flue gas.

* * * * *